US005683313A

United States Patent [19]

Disco et al.

[11] Patent Number: 5,683,313

[45] Date of Patent: Nov. 4, 1997

[54] VENTED GOLF TEE

[75] Inventors: Thomas A. Disco, Acworth; Charles R. Parish, Jr., Powder Springs, both of Ga.

[73] Assignee: Velocity Golf Products, Inc., Hiram, Ga.

[21] Appl. No.: 437,458

[22] Filed: May 8, 1995

Related U.S. Application Data

[63] Continuation-in-part of Ser. No. 183,740, Jan. 19, 1994, Pat. No. 5,413,330.

[51] Int. Cl.[6] ..... A63B 57/00

[52] U.S. Cl. ..... 473/387

[58] Field of Search ..... 473/402, 403, 473/396, 393, 387, 399

[56] References Cited

U.S. PATENT DOCUMENTS

| | | | |
|---|---|---|---|
| D. 219,347 | 12/1970 | Letts, Jr. | D21/208 |
| D. 252,109 | 6/1979 | Clugage | D21/208 |
| 1,410,483 | 3/1922 | Lard | 473/396 |
| 1,554,721 | 9/1925 | Getchell | 473/403 |
| 1,584,832 | 5/1926 | Benneke | 473/396 |
| 1,645,001 | 10/1927 | Hodges | 473/399 |
| 1,738,596 | 12/1929 | McLeod | 473/402 |
| 1,783,211 | 12/1930 | Baldwin | 473/387 |
| 1,959,347 | 5/1934 | Czichos | D21/234 X |
| 2,011,203 | 8/1935 | Seike | 473/396 |
| 3,414,268 | 12/1968 | Chase | 273/207 |
| 3,907,289 | 9/1975 | Bondu | 473/403 |
| 4,192,504 | 3/1980 | Cluggage | 273/33 |
| 4,336,940 | 6/1982 | Sprague | 473/393 |
| 4,783,077 | 11/1988 | Lemon | 273/211 |
| 4,787,637 | 11/1988 | Lima | 273/211 |
| 4,838,285 | 6/1989 | Petrone | 473/387 |
| 4,948,130 | 8/1990 | Ryborn | 273/33 |
| 5,301,950 | 4/1994 | Patterson | 473/396 |
| 5,413,330 | 5/1995 | Disco et al. | 273/33 |

OTHER PUBLICATIONS

Drawing of the Later Version of the Apparatus Disclosed in U.S. Pat. 3,907,289 (i.e. reference A above).

Figures 1–7 of U.S. Ser. No. 08/437,458.

*Primary Examiner*—Theatrice Brown

*Attorney, Agent, or Firm*—Isaf, Vaughan & Kerr; Louis T. Isaf

[57] ABSTRACT

A shortened unitary golf tee includes a pointed base portion for insertion into the ground and a hollow body portion for receiving a golf ball. The body portion includes a side wall defining an inner cavity and a ball receipt surface which substantially surrounds a first aperture extending into the inner cavity. The side wall also defines a second smaller aperture, or vent, extending through the side wall into the inner cavity. Regardless of the location of the second aperture, if air is allowed to flow freely into the inner cavity, it is thought to minimize the effects of depressurization between the golf tee and an accelerating golf ball departing the golf tee so that the golf tee tends to remain stationary and the golf ball retains more momentum from the golf club. In the preferred embodiment, the second aperture is located on the top of a short, upward-facing side of the golf tee to reduce the amount of area on the golf tee most likely to be impacted by a club head and to provide a more intuitive means for properly positioning and aligning the golf tee. The second aperture is located in various inventive configurations in alternate embodiments.

9 Claims, 5 Drawing Sheets

VENTED GOLF TEE

CROSS REFERENCE TO RELATED APPLICATIONS

This application is a continuation-in-part of application Ser. No. 08/183,740, filed Jan. 19, 1994, and now U.S. Pat. No. 5,413,330.

BACKGROUND OF THE INVENTION

The present invention relates generally to the field of golf tees, and more specifically, to the field of hollow, angled golf tees.

Golf tees have been around for generations providing golfers controlled surfaces for hitting golf balls. While the most common type of golf tee is a small, solid piece of wood or plastic designed to be inserted perpendicularly into the ground, another type of golf tee is disclosed in U.S. Pat. No. 3,907,289 (the '289 patent) which is hollow and designed to be inserted into the ground at an angle. In addition, at least one variation of the angled golf tee disclosed in that patent has been on sale for a number of years and is characterized by being shorter (3 inches long) and having a ball receipt surface which is both recessed and more perpendicular (60° relative to the longitudinal axis of the golf tee).

While the previous angled golf tees (the golf tee disclosed in the '289 patent and the shorter, more perpendicular golf tee variation) have experienced relative degrees of success, golfers have complained of the tendency of those tees to take flight with the golf balls, resulting in a large loss of golf tees. While the loss of an inexpensive solid golf tee is often lightly regarded, the loss of a more expensive angled golf tee is more serious. In addition, it is thought that the use of a prior angled golf tee has an adverse effect on the flight characteristics of a golf ball. Furthermore, without explicit instruction, the proper placement and orientation of the prior golf tees is not very intuitive (e.g., the prior angled golf tee may appear to some to work just as well in an orientation reversed, or otherwise different, from that shown in the '289 patent).

There is, therefore, a need in the industry for an apparatus which addresses these and other related, and unrelated, problems.

SUMMARY OF THE INVENTION

Briefly described, the present invention includes, in its most preferred embodiment, a shortened unitary golf tee which includes a pointed base portion for insertion into the ground and a hollow body portion for receiving a golf ball. The body portion includes a side wall defining an inner cavity and a ball receipt surface which at least substantially surrounds a first aperture extending into the inner cavity for receipt of the golf ball. The side wall also defines a second smaller aperture, or vent, extending through the side wall into the inner cavity. Regardless of the location or shape of the second aperture, if air is allowed to flow freely into the inner cavity, it is thought to have been unexpectedly discovered that such a flow of air will tend to minimize adverse effects of depressurization between the golf tee and an accelerating golf ball departing the golf tee so that the golf tee tends to remain stationary and the golf ball retains more momentum from the golf club.

The side wall of the body portion includes a short side and a long side. When the golf tee is correctly positioned, the short side faces upward, and the long side faces downward and extends toward the golf hole. In the preferred embodiment of the present invention, the second aperture has the shape of an inverted "V" and is located at the top of the short side of the side wall extending from the first aperture and is oriented pointed toward the first aperture. In this location, it has been unexpectedly discovered that the second aperture reduces golf tee striking area by replacing an area on the golf tee most likely to be impacted by a club head which could cause the golf tee to take flight or reduce momentum applied to the golf ball. In addition, the shape and orientation of the second aperture of the preferred embodiment of the present invention assist in providing a more intuitive means for properly positioning and aligning the golf tee.

In accordance with a first alternate embodiment of the present invention, the second aperture defines a circular shape and is located in the long side of the side wall. In accordance with second and third alternate embodiments, the second aperture defines the shape of a "V" and is located at the top of the side wall. In the second alternate embodiment the "V" is located in the short side of the side wall, extends from the first aperture, and points away from the first aperture. In the third alternate embodiment the "V" is located in the long side of the side wall, extends from the first aperture, and points away from the first aperture. In addition, the shape and orientation of the second aperture of the alternate embodiments of the present invention assists in providing a more intuitive means for properly positioning and aligning the golf tee.

In accordance with each of the above-identified embodiments of the present invention, the unique location of the second aperture alone assists in providing a more intuitive means for properly positioning and aligning the golf tee. In particular, most preferably, in a top plan view of the ball receipt surface, the ball receipt surface defines a an oval shape, which oval shape defines an elongated centerline defined between the two most distant points of the oval shape. In accordance with each of the above-identified embodiments, a vertical plane defined by that elongated centerline bisects the second aperture, the base, and the body such that a more intuitive means for properly positioning and aligning the golf tee is provided.

It is therefore an object of the present invention to provide a better golf tee.

Another object of the present invention is to provide a more advanced and inventive variation of a hollow, angled golf tee.

Another object of the present invention is to provide a golf tee which includes means for minimizing adverse effects of depressurization between the golf tee and an accelerating golf ball departing the golf tee.

Yet another object of the present invention is to provide a hollow golf tee which includes an upper aperture for receiving a golf ball and a vent for allowing air flow into the hollow golf tee.

Yet another object of the present invention is to provide a golf tee with a reduced striking area.

Still another object of the present invention is to provide a hollow golf tee with an upper aperture and a side wall aperture extending from the upper aperture.

Still another object of the present invention is to provide an angled hollow golf tee with an intuitive placement indicator.

Still another object of the present invention is to provide a shortened golf tee.

Other objects, features and advantages of the present invention will become apparent upon reading and understanding the present specification, when taken in conjunction with the accompanying drawings.

DETAILED DESCRIPTION OF THE PREFERRED EMBODIMENT

Figure 1:
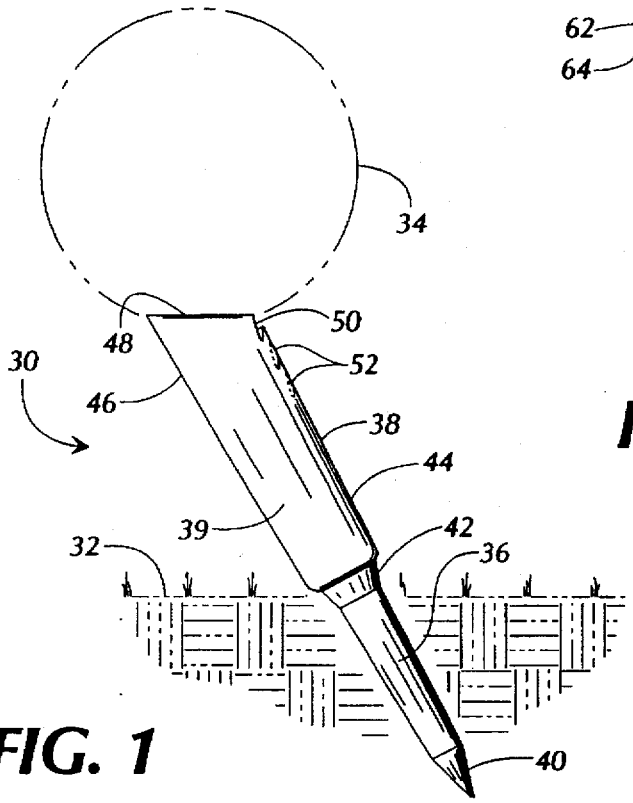
FIG. 1 is a side elevational view of a vented golf tee in accordance with the preferred embodiment of the present invention shown positioned in the ground supporting a golf ball represented in broken lines.
Figure 2:
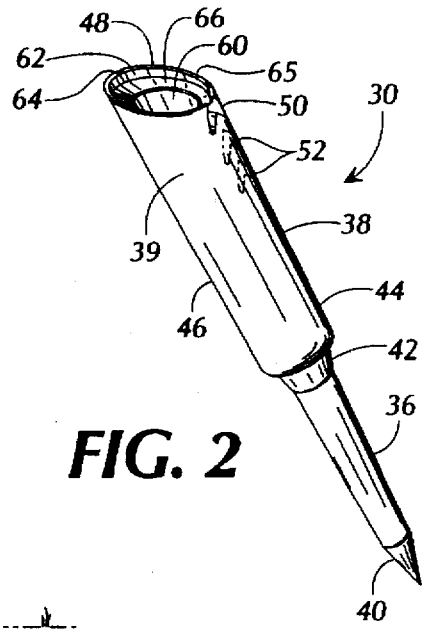
FIG. 2 is a side perspective view of the vented golf tee of FIG. 1.
Figure 3:
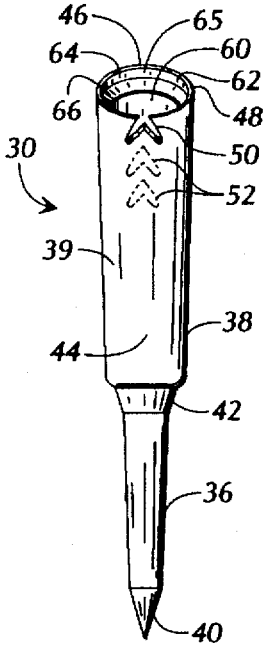
FIG. 3 is a front elevational view of the vented golf tee of FIG. 1.

Referring now in greater detail to the drawings in which like numerals represent like components throughout the several views, FIG. 1 shows a side elevational view of a vented golf tee 30 in accordance with the preferred embodiment of the present invention shown positioned in the ground 32 supporting a golf ball 34 represented in broken lines. Refer also to FIGS. 2 and 3 which show side perspective and front elevational views, respectively, of the vented golf tee 30. The vented golf tee 30 includes a base 36 and a hollow body 38 including a side wall 39. The base 36 includes a base point 40 for easy insertion into the ground 32 up to a body seat 42 serving as a transition between the base 36 and the body 38. The side wall 39 of the body 38 includes a short side 44 and a long side 46 due to the formation of an angled ball receipt surface 48.

A vent 50 (e.g. opening) having an inverted "V" shape is shown extending through the short side 44 of the side wall 39 of the body 38 A pair of directional indicia 52 having similar shapes to the vent 50 are printed on the short side 44 just below the vent 50. The directional indicia 52 are represented by broken lines in FIGS. 1, 2, 3, and 5. The side wall 39 of the body 38 surrounds an inner cavity 60. The ball receipt surface 48, which because of its angle has the planar shape of an oval, substantially surrounds a ball aperture 62 (e.g. opening). At the upper end of the side wall 39 just below the ball receipt surface 48, a ball recess 64 (e.g. a countersink) is defined in the side wall 39 by a recess wall 65 and a slanted recess shoulder 66 as part of the side wall 39. The vent 50 is shown extending through both the recess wall 65 and the slanted recess shoulder 66 to communicate with both the inner cavity 60 and the ball aperture 62.

Figure 4:
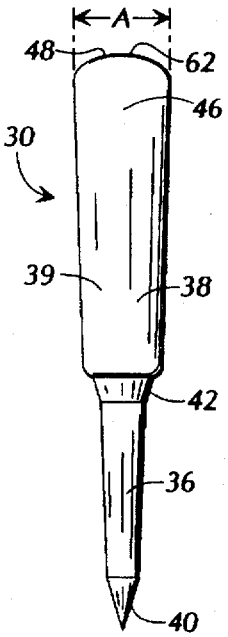
FIG. 4 is a rear elevational view of the vented golf tee of FIG. 1.
Figure 5:
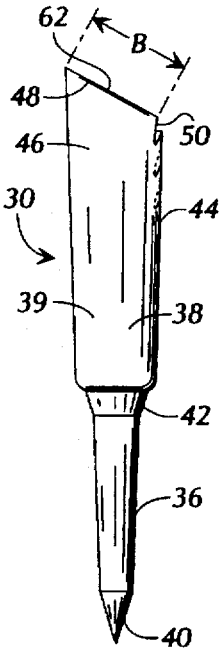
FIG. 5 is a side elevational view of the vented golf tee of FIG. 1, the side opposite being a mirror image.
Figure 6:
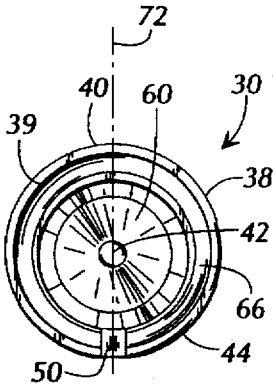
FIG. 6 is an enlarged top plan view of the vented golf tee of FIG. 1.
Figure 7:
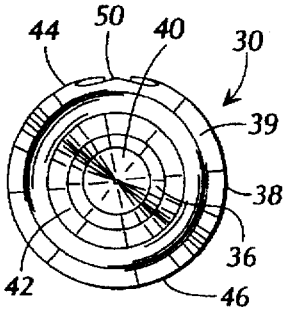
FIG. 7 is an enlarged bottom plan view of the vented golf tee of FIG. 1.

Referring now to FIG. 4 which shows a rear elevational view of the vented golf tee 30, the width of the ball receipt surface 48, and thus the approximate width of the ball aperture 62, is represented as dimension "A". While the dimensions disclosed herein refer to the preferred dimensions for the preferred embodiment of the present invention, other embodiments of the present invention are contemplated which vary in size and shape from that of the embodiments shown in the accompanying drawings. Dimension "A" is preferably approximately 1.4 cm. FIG. 5 shows a side elevational view of the vented golf tee 30. Dimension "B" represents the planar length of the ball receipt surface 48, and thus the approximate planar length of the ball aperture 62. Dimension "B" is preferably approximately 1.6 cm. FIGS. 6 and 7 show top and bottom plan views, respectively, of the vented golf tee 30. The vent 50 is shown extending through the short side 44 on both figures.

Figure 8:
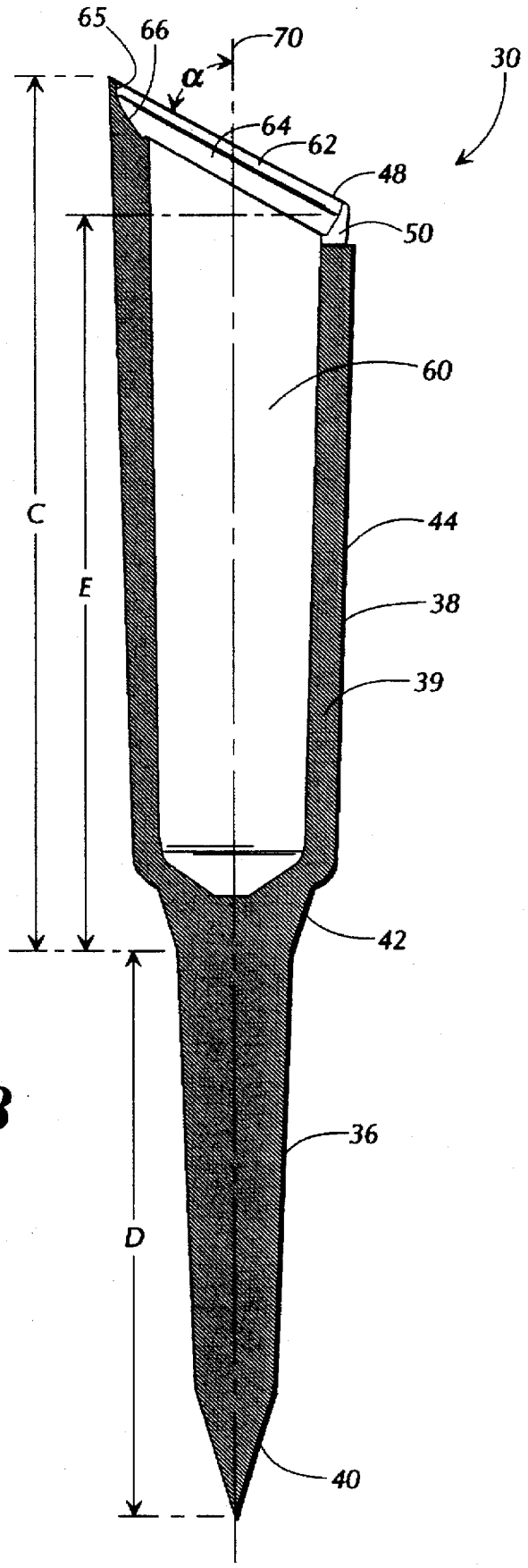
FIG. 8 is a side cross-sectional view of the vented golf tee of FIG. 1.
Figure 9:
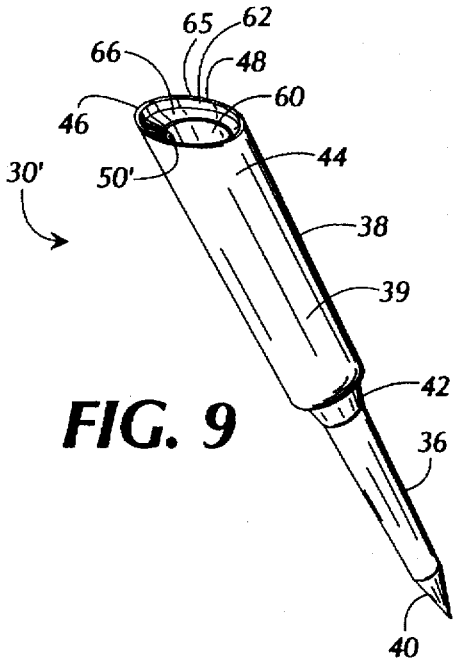
FIG. 9 is a side perspective view of a vented golf tee in accordance with the first alternate embodiment of the present invention.
Figure 10:
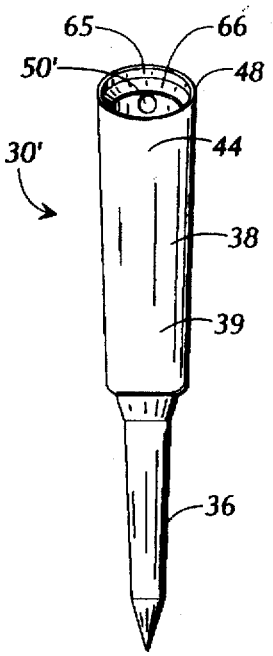
FIG. 10 is a front elevational view of the vented golf tee of FIG. 9.
Figure 11:
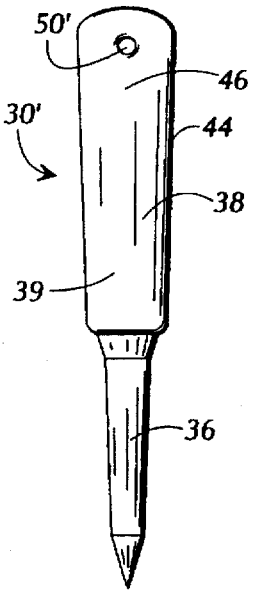
FIG. 11 is a rear elevational view of the vented golf tee of FIG. 9.
Figure 12:
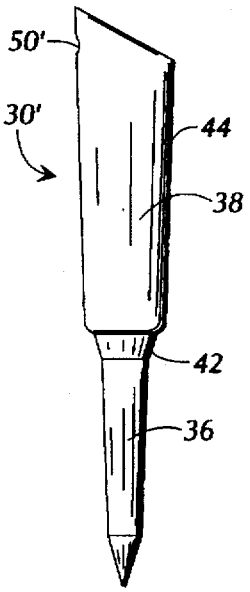
FIG. 12 is a side elevational view of the vented golf tee of FIG. 9, the side opposite being a mirror image.
Figure 13:
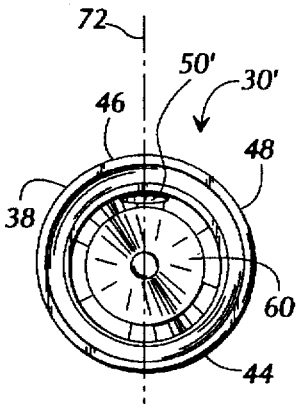
FIG. 13 is an enlarged top plan view of the vented golf tee of FIG. 9.
Figure 14:
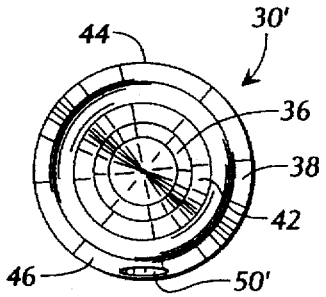
FIG. 14 is an enlarged bottom plan view of the vented golf tee of FIG. 9.
Figure 15:
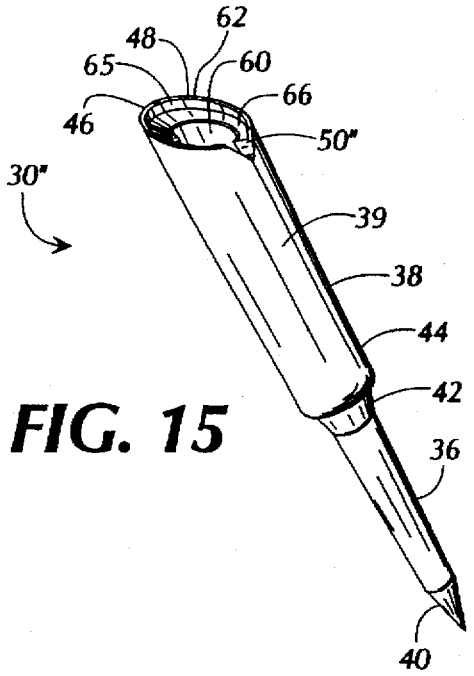
FIG. 15 is a side perspective view of a vented golf tee in accordance with the second alternate embodiment of the present invention.
Figure 16:
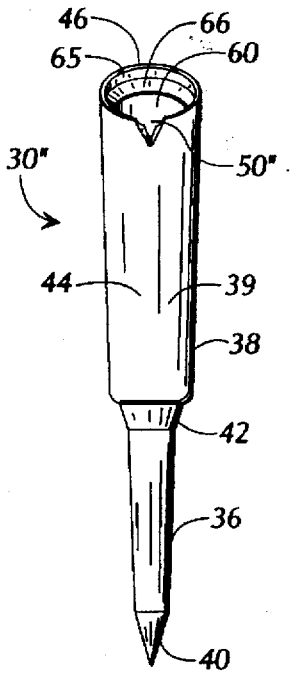
FIG. 16 is a front elevational view of the vented golf tee of FIG. 15.
Figure 17:
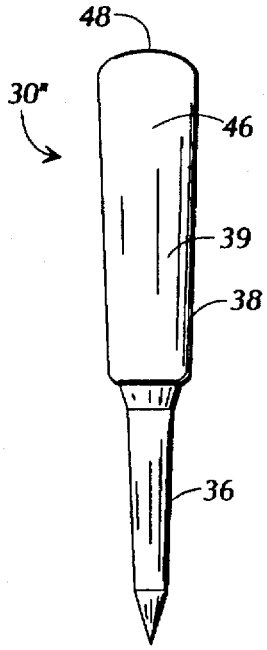
FIG. 17 is a rear elevational view of the vented golf tee of FIG. 15.
Figure 18:
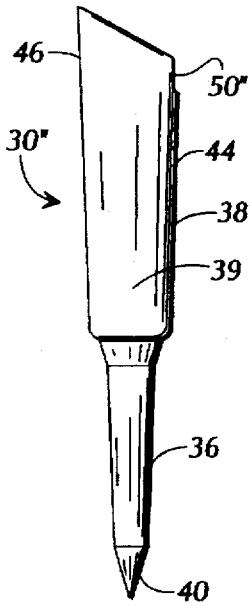
FIG. 18 is a side elevational view of the vented golf tee of FIG. 15, the side opposite being a mirror image.
Figure 19:
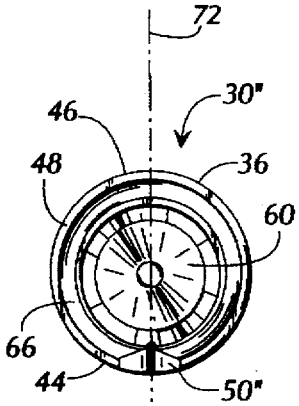
FIG. 19 is an enlarged top plan view of the vented golf tee of FIG. 15.
Figure 20:
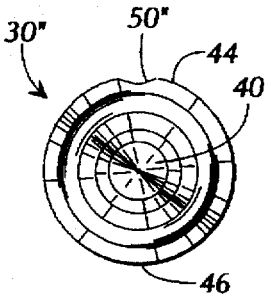
FIG. 20 is an enlarged bottom plan view of the vented golf tee of FIG. 15.
Figure 21:
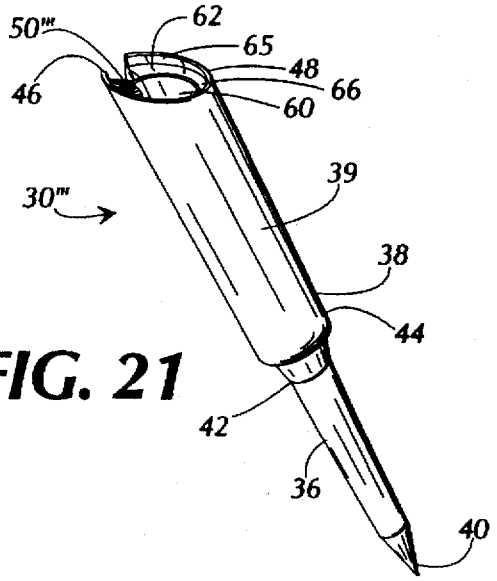
FIG. 21 is a side perspective view of a vented golf tee in accordance with the third alternate embodiment of the present invention.
Figure 22:
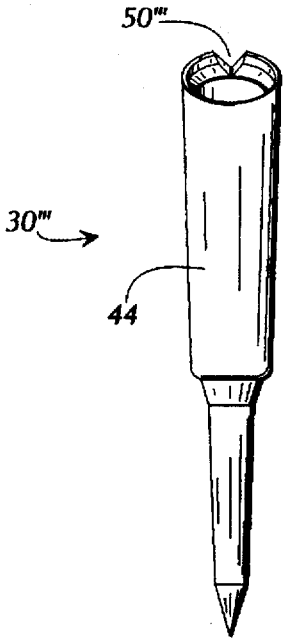
FIG. 22 is a front elevational view of the vented golf tee of FIG. 21.
Figure 23:
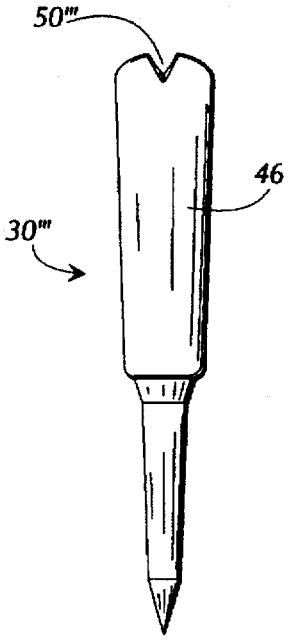
FIG. 23 is a rear elevational view of the vented golf tee of FIG. 21.
Figure 24:
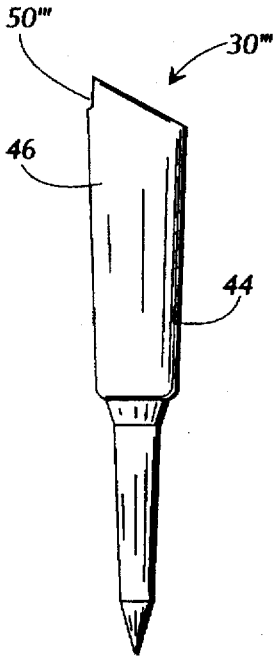
FIG. 24 is a side elevational view of the vented golf tee of FIG. 21, the side opposite being a mirror image.
Figure 25:
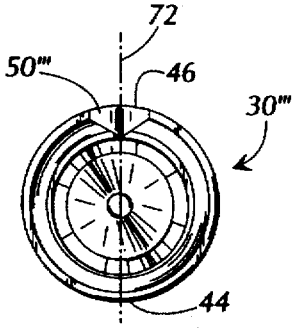
FIG. 25 is an enlarged top plan view of the vented golf tee of FIG. 21.
Figure 26:
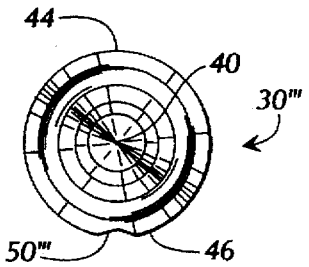
FIG. 26 is an enlarged bottom plan view of the vented golf tee of FIG. 21.

FIG. 8 shows a side cross-sectional view of the vented golf tee 30. A longitudinal axis 70 is shown defined as a centerline theoretically extending through the vented golf tee 30. The vent 50 (FIGS. 1, 2, 3, and 5) is elongated such that it extends in the longitudinal direction, whereby when the vented golf tee 30 is inserted into the ground 32 in a preferable manner, discussed below, both the vent 50 and the vented golf tee 30 point generally toward a distant ball hole or cup (not shown but toward and into which the ball 34 is preferably hit). The ball receipt surface 48 of the side wall 39 of the body 38 is formed at an angle to the longitudinal axis 70 as represented by angle "$\alpha$". According to the preferred embodiment of the present invention, the angle "$\alpha$" is approximately 60°. The ball recess 64 (e.g. countersink) is shown defined by the recess wall 65 and the slanted recess shoulder 66 extending downward into the inner cavity 60. The vent 50 is shown extending through the short side 44 of the side wall 39 at a location where the vent 50 extends through the recess shoulder 66 and recess wall 65 to communicate with ball aperture 62 and the inner cavity 60. The height of the long side 46 of the body 38 is represented as dimension "C", while the height of the short side 44 is represented as dimension "E", and the height of the base 36 is represented as dimension "D". In the preferred embodiment of the present invention, dimension "C" is approximately 4.4 cm, dimension "E" is approximately 3.6 cm, and dimension "D" is approximately 2.8 cm. Thus, the overall length of the vented golf tee 30 of the preferred embodiment of the present invention is approximately 7.2 cm (2.8 inches).

With reference to FIGS. 1–8, the vented golf tee 30 is preferably used by inserting the vented golf tee 30 into the ground 32 at the angle shown in FIG. 1 (approximately 60°) so that the ball receipt surface 48 is horizontal and the vent 50 and directional indicia 52 point toward the distant ball hole or cup (not shown, but toward and into which the ball 34 is preferably hit) that is partially within the ground 32, as would be understood by those reasonably skilled in the art. When the vented golf tee 30 is oriented as depicted in FIG. 1, the cup (or other point to which it is desirous to hit the ball 34) is preferably directly rearward from the vented golf tee 30. The shape and orientation of the vent 50 alone, as well as in combination with the directional indicia 52, assists the golfer in properly placing and orienting the vented golf tee 30 by providing a placement indicator which is intuitively easy to understand and remember. As mentioned above, in a top plan view of the ball receipt surface 48, the ball receipt surface 48 defines an oval shape. That oval shape defines an elongated centerline 72 (see FIG. 6) that extends between the two most distant points of the oval shape. In accordance with the preferred embodiment, a vertical plane defined by the elongated centerline 72 bisects the vent 50, the base 36, and the body 38 such that a more intuitive means for properly positioning and aligning the golf tee is provided. The vented golf tee 30 is preferably inserted into the ground 32 such that the vertical plane defined by the elongated centerline 72 bisects the cup (or other point to which it is desirous to hit the ball 34).

The golf ball 34 is placed onto the ball receipt surface 48, at which point a portion of the golf ball 34 will enter the ball aperture 62 and rest within the ball recess 64 supported by the ball receipt surface 48. As the golfer strikes the golf ball 34 and the golf ball 34 begins to accelerate away from the vented golf tee 30, it is believed that the vent 50 also serves other very important purposes. It is believed that as the golf ball 34 accelerates, a region of depressurization forms behind the golf ball 34. The air within the inner cavity 60 then tends to flow into this depressurization region to equalize the pressure gradient between the two areas. Without the vent 50, it is further believed that an un-vented hollow golf tee itself would be drawn to follow the movement of air attempting to vacate the inner cavity. This tendency on the part of the un-vented golf tee increases the chance that the golf tee will take flight along with the golf ball 34 until gravity and drag bring the un-vented golf tee back to the ground, at which point the un-vented golf tee may be lost to the golfer. This "suction" or "vacuum" effect between the golf ball 34 and the un-vented golf tee would also, it is believed, have an adverse impact on the flight characteristics of the golf ball 34 since it would appear that the golf ball 34 would lose momentum and rotation in dragging the un-vented golf tee along through the air. The vent 50 of the vented golf ball 30 appears to solve these problems by allowing air to flow freely into the inner cavity to replace the air vacating into the depressurization region. Thus, the depressurization region is more rapidly equalized to minimize the chance of tee flight and to minimize any adverse effects on the flight of the golf ball 34.

In addition, in accordance with the preferred embodiment, the vent 50 is located at the point on the vented golf tee 30 most likely to be impacted by a golf club swung too low. Therefore, besides making the strike area on the vented golf tee 30 smaller, the strike area has been reduced at what appears to be the most important location because of the vent 50. As a result, if the vented golf tee 30 is less likely to be hit by a golf club, it is less likely to take flight with the golf ball 34. Furthermore, the vent 50 increases the chance of a clean hit on the golf ball 34 which will provide more momentum, and thus speed, to the golf ball 34. Also, because the vent 50 extends into the ball aperture 62 through the ball receipt surface 48, it is believed that it would be impossible to create a complete seal around the golf ball 34 at the ball receipt surface 48 so that frictional interaction between the vented golf tee 30 and the golf ball 34 is reduced. According to the preferred embodiment of the present invention, the vented golf tee 30 is constructed of a resilient material, such as plastic, which is flexible and strong enough to resist shattering or splintering when struck by a golf club.

Refer now to FIGS. 9–14 which show various views of a vented golf tee 30' in accordance with the first alternate embodiment of the present invention. While similar to the vented golf tee 30 of the preferred embodiment in most ways, the vented golf tee 30' includes, rather than the vent 50 as shown in FIG. 3, a circular vent 50' (e.g. opening) extending into the inner cavity 60 through the long side 46 of the side wall 39 of the body 38. Although the shape and location of the vent 50' have varied from that of the preferred embodiment, it nonetheless is effective in allowing air to enter the inner cavity to reduce the vacuum effect discussed above. In addition, by placing the "hole toward the hole", placement and orientation of the vented golf tee 30' remain intuitive. The vent 50' is elongated such that it extends in the longitudinal direction (see, for example, the longitudinal axis 70 in FIG. 8). In accordance with the first alternate embodiment, in a top plan view of the ball receipt surface 48, the ball receipt surface 48 defines an oval shape. That oval shape defines an elongated centerline 72 (see FIG. 13) that extends between the two most distant points of the oval shape. In accordance with the first alternate embodiment, a vertical plane defined by the elongated centerline 72 bisects the vent 50', the base 36, and the body 38 such that a more intuitive means for properly positioning and aligning the vented golf tee 30' is provided. Further, vented golf tee 30' is preferably inserted into the ground 32 (FIG. 1) such that the vertical plane defined by the elongated centerline 72 (FIG. 13) bisects the cup (or other point to which it is desirous to hit the ball 34 (FIG. 1)).

FIGS. 15–20 show various views of a vented golf tee 30" of the second alternate embodiment of the present invention. Again, while very similar to the vented golf tee 30 of the preferred embodiment, the vented golf tee 30" includes a vent 50" (e.g. opening) in the shape of a non-inverted, un-filled "V" extending through the short side 44 into the inner cavity 60 from the ball aperture 62. The shape, orientation, and placement of the vent 50" also provides many of the benefits discussed above with respect to the vented golf tee 30 of the preferred embodiment. In addition, more strike area on the vented golf tee 30" has been removed to further reduce the chance of impacting the vented golf tee 30" with the golf club. The vent 50" is elongated such that it extends in the longitudinal direction (see, for example, the longitudinal axis 70 in FIG. 8). In accordance with the second alternate embodiment, in a top plan view of the ball receipt surface 48, the ball receipt surface 48 defines an oval shape. That oval shape defines an elongated centerline 72 (see FIG. 19) that extends between the two most distant points of the oval shape. In accordance with the second alternate embodiment, a vertical plane defined by the elongated centerline 72 bisects the vent 50", the base 36, and the body 38 such that a more intuitive means for properly positioning and aligning the golf tee is provided. Further, vented golf tee 30" is preferably inserted into the ground 32 (FIG. 1) such that the vertical plane defined by the elongated centerline 72 (FIG. 19) bisects the cup (or other point to which it is desirous to hit the ball 34 (FIG. 1)).

FIGS. 21–26 show various views of a vented golf tee 30'" of the third alternate embodiment of the present invention. Again, while very similar to the vented golf tee 30 of the preferred embodiment, the vented golf tee 30'" includes a vent 50'" (e.g. opening) in the shape of a non-inverted, un-filled "V" extending through the long side 46 into the inner cavity 60 from the ball aperture 62. The shape, orientation, and placement of the vent 50'" also provides many of the benefits discussed above with respect to the vented golf tee 30 of the preferred embodiment. The vent 50'" is elongated such that it extends in the longitudinal direction (see, for example, the longitudinal axis 70 in FIG. 8). In accordance with the third alternate embodiment, in a top plan view of the ball receipt surface 48, the ball receipt surface 48 defines an oval shape. That oval shape defines an elongated centerline 72 (see FIG. 25) that extends between the two most distant points of the oval shape. In accordance with the third alternate embodiment, a vertical plane defined by the elongated centerline 72 bisects the vent 50'", the base 36, and the body 38 such that a more intuitive means for properly positioning and aligning the golf tee is provided. Further, vented golf tee 30'" is preferably inserted into the ground 32 (FIG. 1) such that the vertical plane defined by the elongated centerline 72 (FIG. 25) bisects the cup (or other point to which it is desirous to hit the ball 34 (FIG. 1)).

The third alternate embodiment of the present invention is within the broad scope of the U.S. Pat. No. 5,413,330 which has issued in the name of the inventors of this application. More particularly, the broad scope of U.S. Pat. No. 5,413,330 covers the vent 50'". Nonetheless, one of the purposes of the present application is to identify and specifically claim a specific species embodiment, which species embodiment is the third alternate embodiment discussed above, and which third alternate embodiment is inventive beyond (i.e., is non-obvious in light of) that which is disclosed in U.S. Pat. No. 5,413,330.

Still other alternate embodiments of the present invention are contemplated and considered to be within the scope of the present invention. One particular embodiment includes placing multiple holes around and through the side wall 39, such as through combining the embodiments of FIGS. 1 and 9.

While the embodiments of the present invention which have been disclosed herein are the preferred forms, other embodiments of the present invention will suggest themselves to persons skilled in the art in view of this disclosure. Therefore, it will be understood that variations and modifications can be effected within the spirit and scope of the invention and that the scope of the present invention should only be limited by the claims below.

We claim:

1. A golf tee comprising:

a top;

a bottom;

a pointed base portion at said bottom; and a body portion connected to and extending upward from said base portion and including a side wall, wherein said side wall at least partially bounds and defines an inner cavity within said body portion, wherein said side wall defines a ball receipt surface at least partially surrounding and defining a first opening into said inner cavity, wherein said side wall includes a long side and an opposing short side, and wherein said side wall defines a second opening extending through said long side of said side wall into said inner cavity.

2. The golf tee of claim 1, wherein said second opening defines a "V-shaped" vent which is pointed toward said ball receipt surface.

3. The golf tee of claim 1, wherein said second opening defines a "V-shaped" vent which is pointed away from said ball receipt surface.

4. The golf tee of claim 1, wherein said side wall defines a countersink at said top of the golf tee.

5. The golf tee of claim 1, wherein said body portion defines a longitudinal axis extending in a direction between said top and said bottom, and wherein said ball receipt surface lies within a plane that is oblique relative to said longitudinal axis.

6. The golf tee of claim 1, wherein the golf tee defines a longitudinal axis extending in a direction defined between said top and said bottom, and wherein said second opening is elongated and extends in said longitudinal direction.

7. The golf tee of claim 1, wherein said second opening defines a circular shape.

8. The golf tee of claim 1, wherein said second opening extends into said first opening.

9. The golf tee of claim 1, wherein said second opening is disposed below and distant from said ball receipt surface.

* * * * *